US005727935A

United States Patent [19]

Shigeoka et al.

[11] Patent Number: 5,727,935

[45] Date of Patent: Mar. 17, 1998

[54] SCROLL TYPE FLUID MACHINE HAVING A ROTATABLE CYLINDRICAL RING ON THE DRIVE BUSH

[75] Inventors: Tetsuo Shigeoka; Katsuhisa Tomatsu; Kazuaki Takahashi, all of Nagoya, Japan

[73] Assignee: Mitsubishi Jukogyo Kabushiki Kaisha, Tokyo, Japan

[21] Appl. No.: 589,008

[22] Filed: Jan. 19, 1996

[30] Foreign Application Priority Data

Mar. 13, 1995 [JP] Japan ..... 7-52374

[51] Int. Cl.[6] ..... F01C 1/04; F01C 21/02; F01C 21/04

[52] U.S. Cl. ..... 418/55.5; 418/55.6; 418/57

[58] Field of Search ..... 418/55.1, 55.5, 418/55.6, 57

[56] References Cited

U.S. PATENT DOCUMENTS

| | | | |
|---|---|---|---|
| 3,884,599 | 5/1975 | Young et al. | 418/55.5 |
| 4,875,840 | 10/1989 | Johnson et al. | 418/55.5 |
| 4,932,845 | 6/1990 | Kikuchi et al. | 418/55.6 |
| 5,186,616 | 2/1993 | Hirano | 418/55.5 |
| 5,366,357 | 11/1994 | Fukanuma et al. | 418/55.1 |

FOREIGN PATENT DOCUMENTS

| | | |
|---|---|---|
| 0 539 849 | 5/1993 | European Pat. Off. . |
| 4338771 | 5/1994 | Germany . |
| 52-2448 | 7/1977 | Japan . |
| 57-37770 | 8/1982 | Japan . |
| 2025530 | 1/1980 | United Kingdom . |

OTHER PUBLICATIONS

Patent Abstract of Japan, vol. 11, No. 333 (M-637), Oct. 1987 & JP-A-62 113879 (Daikin Ind. Ltd.), 25 May 1987, abstract.

Abstract of a publication entitled "Bearing" (Norimune Soda) issued 1964.

*Primary Examiner*—John J. Vrablik

*Attorney, Agent, or Firm*—Wenderoth, Lind & Ponack

[57] ABSTRACT

A scroll type fluid machine has a swivel scroll (14) driven by a drive bush (101) engaged with a drive shaft bearing portion of the swivel scroll (14) and an eccentric drive pin (25) provided eccentrically on a drive shaft (7). Concentrated surface fatigue caused on the surface of the drive bush (101) is avoided and an elongation of the life of the drive bush (101) is attained by a rotatable cylindrical ring (102) being provided on the outer circumference of the drive bush (101).

7 Claims, 5 Drawing Sheets

SCROLL TYPE FLUID MACHINE HAVING A ROTATABLE CYLINDRICAL RING ON THE DRIVE BUSH

BACKGROUND OF THE INVENTION

1. Field of the Invention

The present invention relates to a scroll type fluid machine to be used as a compressor, an expander, etc.

2. Description of the Prior Art

FIG. 4 is a longitudinal sectional view of a scroll type compressor in the prior art. In the figure, numeral 1 designates a hermetic housing consisting of a cup-like body 2, a front end plate 4 fixed thereto by bolts 3 and a cylindrical element 6 fixed thereto by bolts 5. A rotating shaft 7, passing through the cylindrical element 6, is supported rotatably by the hermetic housing 1 via bearings 8, 9.

Within the housing 1, there are provided a stationary scroll 10 and a swivel scroll 14. The stationary scroll 10 has an end plate 11 and a spiral wrap 12 provided standing on its inner surface. The end plate 11 is connected to the cup-like body 2 by bolts 13 so as to be fixed within the housing 1. By the outer circumferential surface of the end plate 11 and the inner circumferential surface of the housing 1 being in sealing contacted, the inside of the housing 1 is partitioned so as to form a discharge cavity 31 on the outer side of the end plate 11 and a suction chamber 28 on the inner side of the end plate 11. Further, at the center of the end plate 11 is provided a discharge port 29 that is opened and closed by a discharge valve 30. The swivel scroll 14 has an end plate 15 and a spiral wrap 16 provided standingly on its inner surface. The spiral wrap 16 has subdstantially the same shape as the spiral wrap 12 of the stationary scroll 10.

The swivel scroll 14 and the stationary scroll 10 are engaged with each other eccentrically by a length of a revolutional swivel radius and with a deviation of angle of 180 degrees, as shown in the figure. Thus, a tip seal 17 provided buriedly on the tip surface of the spiral wrap 12 being sealingly contacted to the inner surface of the end plate 15, and a tip seal 18 provided buriedly on the tip surface of the spiral wrap 16 being sealingly contacted to the inner surface of the end plate 11, the side surfaces of spiral wraps 12, 16 make line contacts each other at a plurality of places, thereby a plurality of compression chambers 19*a*, 19*b*, being nearly in a point symmetry each other around the centers of the spirals, is formed.

Within a cylindrical boss 20 provided projectingly at the central portion of the outer surface of the end plate 15 is inserted a drive bush 21 so as to be rotatably via a swivel bearing 23. Within a slide groove 24 in the drive bush 21, an eccentric drive pin 25, provided eccentric and projecting at the inner end of the rotating shaft 7, is inserted slidably. The drive bush 21 is fitted with a balance weight 27 for balancing dynamic imbalances caused by revolutional swivel motions of the swivel scroll.

Between the circumferential edge of the outer surface of the end plate 15 and the inner surface of the front end plate 4 are interposed a thrust plate 36 and an Oldham coupling 26. Incidentally, numeral 37 designates a balance weight fixed to the rotating shaft 7.

Thus, upon the rotating shaft 7 being rotated, the swivel scroll 14 is driven via a swivel drive mechanism consisting of the eccentric drive pin 25, the drive bush 21, boss 20, etc. The swivel scroll 14, being prevented from rotating by a rotation preventing mechanism or the Oldham coupling 26, undergoes revolutional swivel motions on a circular track having a revolutional swivel radius, i.e. a radius of the amount of eccentricity between the rotating shaft 7 and the eccentric drive pin 25. Then the line contact portions of the side surfaces of the spiral wraps 12, 16 move gradually in the direction of the spiral centers. As a result, the compression chambers 19*a*, 19*b* move, with the volume thereof being reduced, in the direction of the spiral centers.

Accompanying the above, a gas that has flowed into the suction chamber 28 through a suction port (not shown in the figure) is taken into each compression chamber 19*a*, 19*b* from openings of the outer ends of the spiral wraps 12, 6. While being compressed, the gas arrives in a central chamber 22 and, passing through the discharge port 29 and pushing open the discharge valve 30, it is discharged into the discharge cavity 31, and then flows out through a discharge port (not shown in the figure). Meanwhile, a thrust load acts on the end plate 15 of the swivel scroll 14 due to the compressed gas within the compression chambers 19*a*, 19*b*. This thrust load is supported by the inner surface of the front end plate 4 via the thrust plate 36.

FIG. 3 is an explanatory drawing of gas pressures acting on the swivel scroll 14. A gas pressure $F_P$ acting on the swivel scroll 14 is a combined force of a component force $F_T$ and a component force $F_R$. Because of a geometrical dimensional relationship, $F_T$ is far larger than $F_R$ ($F_T >> F_R$). The direction of the gas pressure $F_P$ acts, as shown in FIG. 3, thus always nearly in a perpendicular direction to the contact direction of the spiral wrap 16 of the swivel scroll 14 and the spiral wrap 12 of the stationary scroll 10. Because this load acts on the drive bush 21 of the swivel drive mechanism to drive the swivel scroll 14 at a certain definite position all through the operation, surface fatigue occur concentrated at one position of the drive bush. Hence there are such shortcomings in that flaking occurs and the life of the drive bush 21 is shortened.

SUMMARY OF THE INVENTION

It is therefore an object of the present invention to solve the above-mentioned shortcomings in the prior art, aiming at avoiding a concentrated surface fatigue caused on the surface of a drive bush so as to remarkably elongate the life thereof.

The present invention which solves the abovementioned shortcomings relates to a scroll type fluid machine in which a swivel scroll is driven by a drive bush engaged with a drive shaft bearing portion of the swivel scroll and an eccentric drive pin provided eccentrically on a drive shaft, which has the following feature or features:

(1) On the outer circumference of the drive bush, a rotatable cylindrical ring is provided.

(2) In the scroll type fluid machine mentioned in (1) above, a step is provided at one end of the drive bush and a stopper plate is provided at the other end thereof so that movement of the cylindrical ring is regulated.

(3) In the scroll type fluid machine mentioned in (1) above, a self-lubricating high molecular compound coating is applied to one surface either of the outer circumference of the drive bush or of the inner circumference of the cylindrical ring.

(4) In the scroll type fluid machine mentioned in (1) above, a path to supply lubricating oil to the sliding portion between the drive bush and the cylindrical ring is formed within the eccentric drive pin and the drive bush.

According to the present invention constructed as above, as the surface of the drive bush moves, even if a load acting on the drive bush from the swivel scroll via a swivel bearing is always concentrated at one position in principle, the concentrated surface fatigue on the surface of the drive bush can be avoided, and a remarkable elongation of the life of the drive bush can be attained.

In the scroll type fluid machine in which the step and the stopper are provided, the cylindrical ring is prevented from coming out.

In the scroll type fluid machine in which the self-lubricating high molecular compound coating is applied, the movement of the cylindrical ring becomes smooth and the concentrated surface fatigue can be avoided.

In the scroll type fluid machine in which a path to supply a lubricating oil to the sliding portion between the drive bush and the cylindrical ring is provided as the mutual movement of the drive bush and the cylindrical ring becomes facilitated, the concentrated surface fatigue can be avoided.

DESCRIPTION OF THE PREFERRED EMBODIMENTS

Figure 1A:
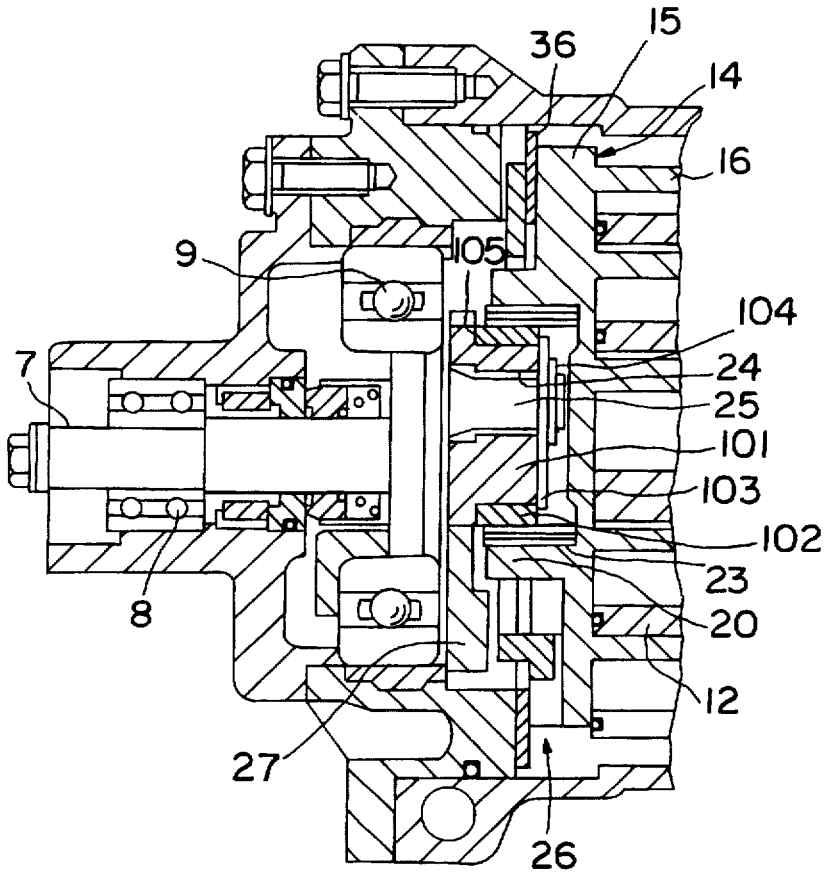
FIG. 1*a* is a longitudinal sectional view of a main portion of a scroll type compressor of a first preferred embodiment according to the present invention.
Figure 1B:
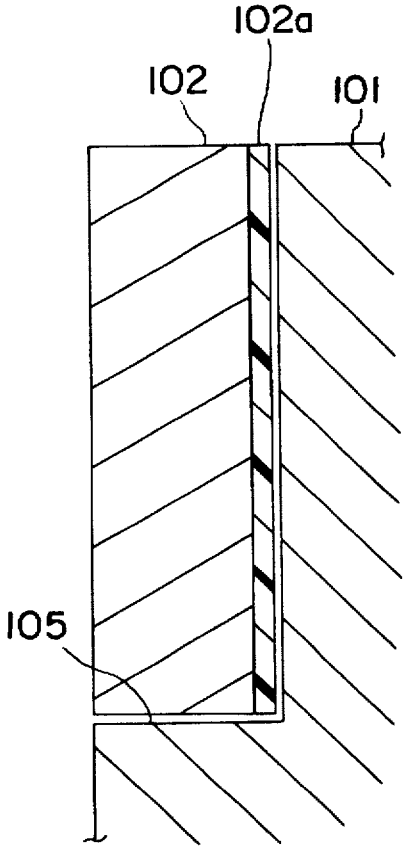
FIGS. 1*b* and 1*c* are partial sectional views of a drive bush and cylindrical ring arrangement.
Figure 1C:
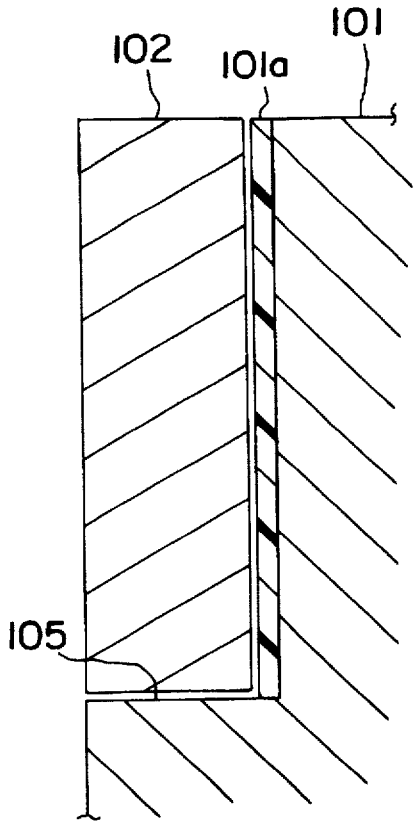

FIG. 1*a* is a longitudinal sectional view of a main portion of a scroll type compressor of a first preferred embodiment according to the present invention. In the figure, numeral 25 designates an eccentric drive pin that is provided eccentrically with respect to a rotating shaft 7 and is inserted in a drive bush 101. At one end of the drive bush 101, a balance weight 27 is fitted. In this preferred embodiment, on the outer circumference of the drive bush 101, a step 105 is provided, and a rotatable cylindrical ring 102 is fitted in the step. On the shaft end side, a stopper plate 103 is provided so that the cylindrical ring 102 is prevented from coming out of the step 105. The stopper plate 103 is fixed by a snap ring 104 fitted in a groove of the end portion of the eccentric drive pin 25. Further, on the outer circumferential surface of the drive bush (FIG. 1*b*) or on the inner circumferential surface of the cylindrical ring (FIG. 1*c*), a self-lubricating high molecular compound coating (102*a*, 101*a*, FIGS. 1*b* and 1*c*) of a small frictional coefficient, for example, a coating of polyamide-imide group resin, etc., is applied. Other portions than those mentioned here are same as those in the prior art.

In the preferred embodiment constructed as above, as the surface of the drive bush moves; even if a load acting on the drive bush from the swivel scroll via a swivel bearing is always concentrated at one position, in principle, concentrated surface fatigue caused on the surface of the drive bush can be avoided, and a remarkable elongation of the life of the drive bush can be attained.

Figure 2:
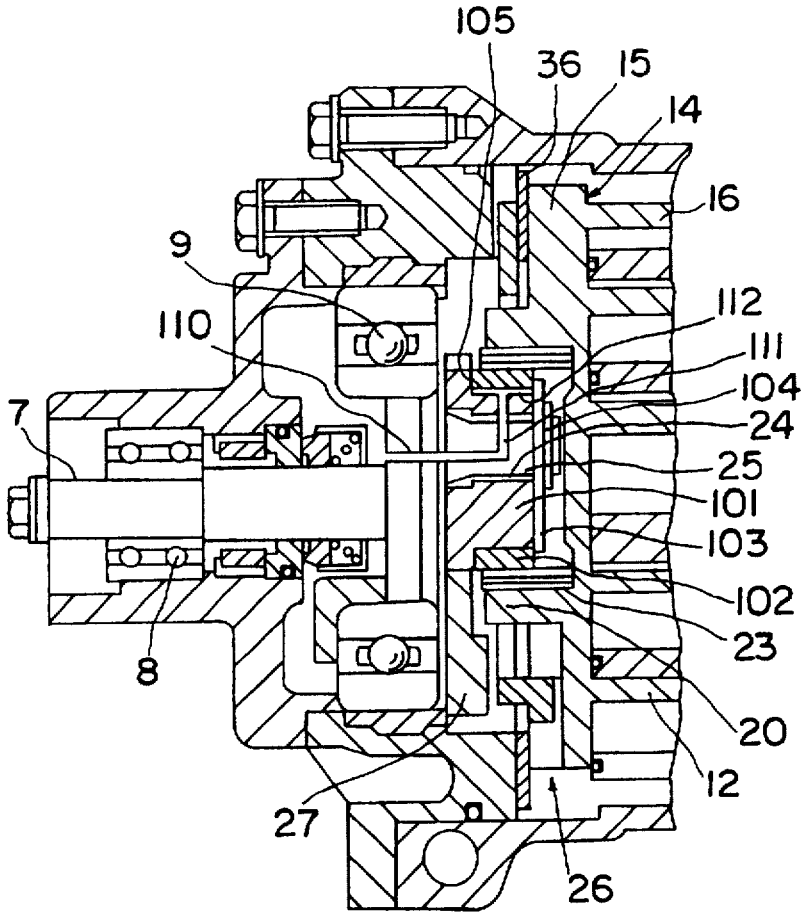
FIG. 2 is a longitudinal sectional view of a main portion of a scroll type compressor of a second preferred embodiment according to the present invention.
Figure 3:
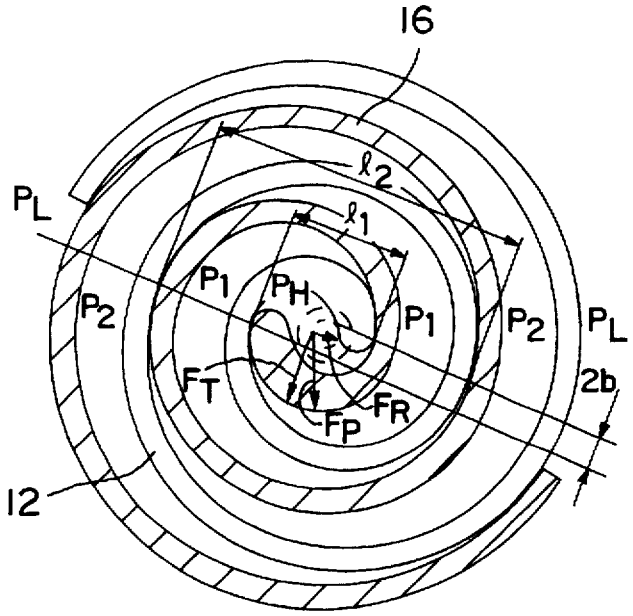
FIG. 3 is an explanatory drawing of gas pressures acting on a swivel scroll.
Figure 4:
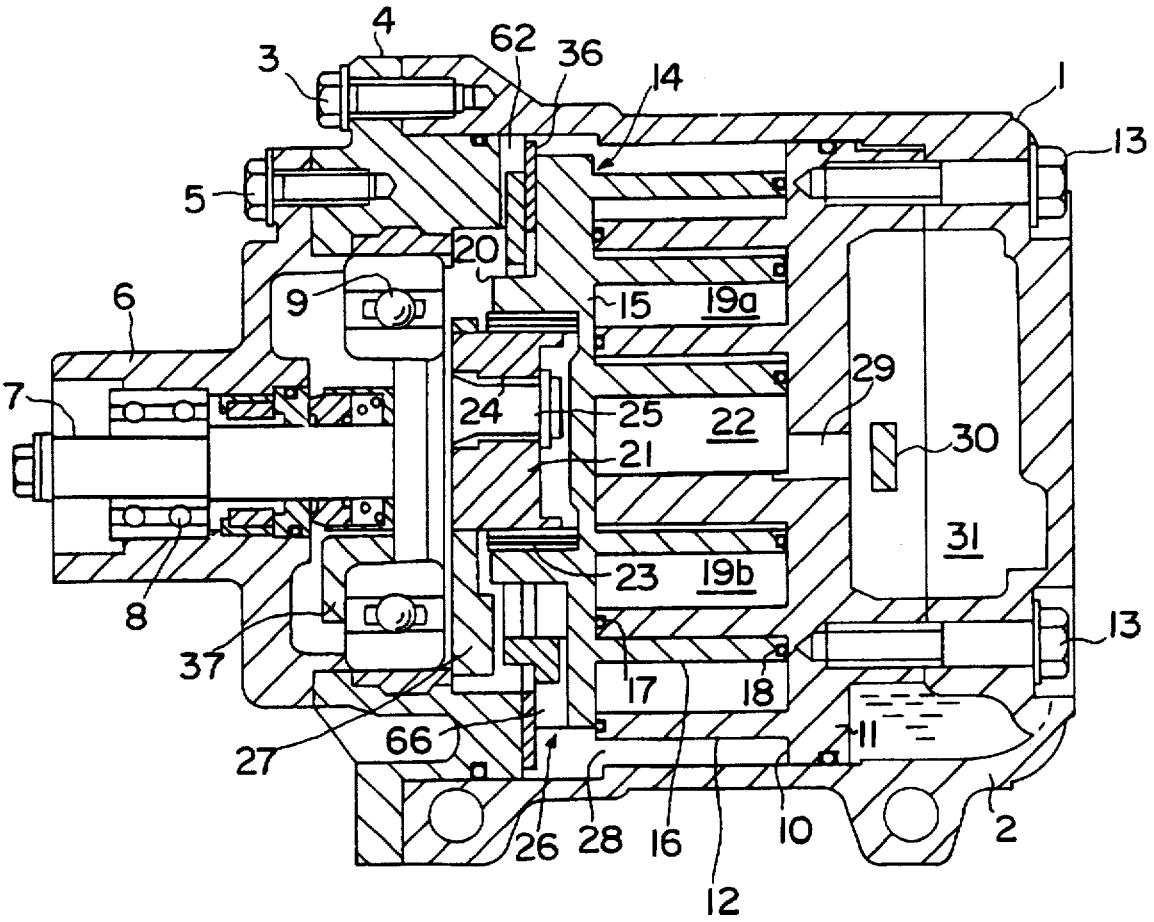
FIG. 4 PRIOR ART
FIG. 4 is a longitudinal sectional view of a scroll type compressor in the prior art.

FIG. 2 is a longitudinal sectional view of a main portion of a scroll type compressor of a second preferred embodiment according to the present invention. In the figure, numeral 110 designates a suction path provided in parallel with a rotating shaft 7 within a larger diameter portion of the rotating shaft 7 and an eccentric drive pin 25. Numeral 111 designates a radial directional path connecting to the suction path 110, provided in a radial direction within the eccentric drive pin 25 and a drive bush 101. Numeral 112 designates a groove connecting with the outside end of the radial directional path 111, provided in parallel with a rotating shaft 7 on the outer circumference of the drive bush 101. The direction of the radial directional path 111 is same as that of the eccentricity of the eccentric drive pin 25. Other portions than those mentioned here are same as those in the first preferred embodiment.

In the construction mentioned above, by an action of a centrifugal force of the radial directional path 111, a gas and an oil contained in the gas enter from the suction path 110 and is supplied into between the drive bush 101 and a cylindrical ring 102 through the radial directional path 111. The gas and the oil collide with the cylindrical ring 102, the oil content sticks to the inner surface of the cylindrical ring 102 to act as lubrication and the gas content comes out from the groove 112 on the outer circumference of the drive bush 101. Thus, without a choke in the flow of oil, the oil supply between the drive bush and the cylindrical ring is ensured. Thereby, mutual movement of the drive bush and the cylindrical ring is made smooth and an elongation of the life of the drive bush can be attained.

In a scroll type fluid machine according to the present invention, as a rotatable cylindrical ring is provided on the outer circumference of a drive bush, or as a step is provided on one end of the drive bush and a stopper plate is provided on the other end thereof so that movement of the cylindrical ring is regulated, or further, as a self-lubricating high molecular compound coating is applied either on the outer circumferential surface of the drive bush or on the inner circumferential surface of the cylindrical ring, or further, as a lubricating oil is supplied into the sliding portion between the drive bush and the cylindrical ring, a concentrated surface fatigue caused on the surface of the drive bush is avoided and a remarkable elongation of the life of the drive bush can be attained.

What is claimed is:

1. A scroll type fluid machine arrangement, comprising:

a non-swivel scroll and a swivel scroll engaged with said non-swivel scroll;

a boss portion on a back face of said swivel scroll;

a swivel bearing at said boss portion;

a drive bush having a slide hole therein, said drive bush being engaged with said swivel bearing, and said drive bush having an outer circumferential portion;

a drive shaft having an eccentric pin provided eccentrically thereon, said eccentric pin being fitted in said slide hole of said drive bush; and a cylindrical ring provided on said outer circumferential portion of said drive bush so as to be rotatable relative to said drive bush and relative to said swivel bearing.

2. The arrangement of claim 1, and further comprising:

a step at one end of said drive bush; and a stopper plate at the other end of said drive bush, said ring being located between said step and said stopper plate so that movement of said ring is regulated.

3. The arrangement of claim 1, and further comprising:

a self-lubricating high molecular compound coating on one surface of one of said outer circumferential portion of said drive bush and an inner circumferential portion of said cylindrical ring.

4. The arrangement of claim 1, and further comprising a lubricating oil path extending through said eccentric pin and said drive bush to said outer circumferential portion of said drive bush.

5. The arrangement of claim 1, wherein said cylindrical ring has an inner surface slidably engaged with said outer circumferential portion of said drive bush and an outer surface slidably engaged with said swivel bearing.

6. The arrangement of claim 5, and further comprising a self-lubricating high molecular compound coating between said outer circumferential portion of said drive bush and said cylindrical ring.

7. A scroll type fluid machine arrangement, comprising:

a swivel scroll having a drive shaft bearing portion;

a drive bush engaged with said drive shaft bearing portion, said drive bush having an outer circumferencial portion;

a drive shaft having an eccentric pin disposed eccentrically thereon, said eccentric pin being engaged with said drive bush;

a rotatable cylindrical ring provided on said outer circumferential portion of said drive bush;

a step at one end of said drive bush; and a stopper plate at the other end of said drive bush, said ring being located between said step and said stopper plate so that movement of said ring is regulated.

* * * * *